US006312882B1

(12) United States Patent
Verbeeck

(10) Patent No.: US 6,312,882 B1
(45) Date of Patent: Nov. 6, 2001

(54) SILVER HALIDE EMULSIONS COMPRISING TABULAR CRYSTALS, EMULSIONS AND THE PROCESSING THEREOF

(75) Inventor: Ann Verbeeck, Begijnendijk (BE)

(73) Assignee: Agfa-Gevaert, Mortsel (BE)

( * ) Notice: Subject to any disclaimer, the term of this patent is extended or adjusted under 35 U.S.C. 154(b) by 1097 days.

(21) Appl. No.: 08/608,321

(22) Filed: Feb. 28, 1996

Related U.S. Application Data

(63) Continuation-in-part of application No. 08/412,872, filed on Mar. 29, 1995, now abandoned.

(30) Foreign Application Priority Data

Apr. 6, 1994 (EP) ..... 94200933

(51) Int. Cl.[7] ..... G03C 1/035

(52) U.S. Cl. ..... 430/569; 430/567; 430/631; 430/545; 430/966

(58) Field of Search ..... 430/567, 569, 430/631, 545, 966

(56) References Cited

U.S. PATENT DOCUMENTS

| | | | | |
|---|---|---|---|---|
| 5,476,761 | * | 12/1995 | Verbeeck et al. | 430/569 |
| 5,543,284 | * | 8/1996 | Verbeeck | 430/569 |
| 5,674,675 | * | 10/1997 | Inoue | 430/567 |
| 5,840,474 | * | 11/1998 | Andriessen et al. | 430/569 |

FOREIGN PATENT DOCUMENTS

| | | | |
|---|---|---|---|
| 0392092 | * | 10/1990 | (EP) . |
| 0517961 | * | 12/1992 | (EP) . |
| 0528476 | * | 2/1993 | (EP) . |
| 5-53230 | * | 3/1993 | (JP) . |
| 5-88285 | * | 4/1993 | (JP) . |

* cited by examiner

*Primary Examiner*—Mark F. Huff
(74) *Attorney, Agent, or Firm*—Breiner & Breiner, L.L.C.

(57) ABSTRACT

A method is disclosed for preparing a light-sensitive silver halide emulsion comprising tabular grains containing colloidal silica sol as a protective colloid, said tabular grains having an average grain thickness of not more than 0.3 $\mu$m, an average aspect ratio of more than 12:1, a total projective area of said tabular grains of at least 50% and a coverage degree by silica sol particles within the range from 50 to 2000%, comprising following steps:

precipitating in a reaction medium silver halide by means of a double-jet or triple-jet technique applied to aqueous solutions of silver nitrate and halide salts in colloidal silica having an average particle size in the range from 0.003 $\mu$m to 0.30 $\mu$m as a protective colloid, in the presence of at least one onium compound, selected from the group consisting of a phosphonium compound, a iodonium compound and an ammonium compound, except for an ammonium compound containing $NH_4^+$-ions; but in the absence of gelatin, wherein a ratio by weight of said colloidal silica to said onium compound(s) is obtained between 3 and 400;

controlling nucleation and growth steps by means of variable flow rate(s) of aqueous solutions of silver nitrate and halide salts and/or by means of constant pAg-values during said steps;

subjecting the reaction medium to at least one physical ripening step;

desalting the reaction medium and redispersing the silver halide obtained;

chemically ripening the silver halide and adjusting a ratio by weight of colloidal silica sol to amount of silver halide, expressed as an equivalent amount of silver nitrate, to a value of at least 0.03 at every moment throughout precipitation in a reaction vessel.

15 Claims, No Drawings

SILVER HALIDE EMULSIONS COMPRISING TABULAR CRYSTALS, EMULSIONS AND THE PROCESSING THEREOF

This is a continuation in part application of Ser. No. 08/412,872, filed Mar. 29, 1995, now abandoned.

FIELD OF THE INVENTION.

The present invention relates to a preparation method of silver halide emulsions comprising tabular crystals, to light-sensitive photographic materials coated from said emulsions and to the processing thereof.

BACKGROUND OF THE INVENTION

The effects of various precipitation conditions on the formation of silver halide emulsions comprising tabular crystals have been A studied extensively as the said tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes U.S. Pat. Nos. 4,063,951; 4,067,739; U.S. Pat. No. 4,150,994; 4,184,877 and 4,184,878. However the tabular grains described herein cannot be regarded as showing a high diameter to thickness ratio, commonly termed aspect ratio. In a number of U.S. Applications filed in 1981 and issued in 1984 tabular grains with high aspect ratio and their advantages in photographic applications are described as e.g. in U.S. Pat. Nos. 4,434,226; 4,439,520; 4,425,425; 4,425,426 and 4,433,048. A survey on high aspect ratio silver halide emulsions appeared in Research Disclosure, Vol 225, January 1983, Item 22534.

The above cited references on tabular grains are mainly concerned with high sensitive silver bromide or silver iodobromide emulsions.

In more recent patent applications emulsions comprising tabular crystals rich in chloride are contemplated. So precipitation conditions including ammonia as disclosed in U.S. Pat. No. 4,399,215 are resulting in rather thick tabular grains. Characteristic for the preparation of emulsions comprising tabular grains rich in chloride is the use of grain growth modifiers as e.g. in U.S. Pat. No. 4,400,463 wherein the preparation is described of a new crystallographic form of tabular silver halide grains rich in chloride by performing the precipitation in the presence of a special peptizer having a thioether linkage and an aminoazaindene growth modifier, adenine being preferred therein. Further U.S. Pat. No. 4,804,621 describes a process for preparing tabular grains rich in chloride in the presence of aminoazapyridine growth modifiers represented by a general formula of which adenine and derivatives are excluded, just as described in EP-A's 0 481 133 and 0 532 801.

In U.S. Pat. No. 4,713,323 the important role of the protective colloid used during the precipitation of emulsions comprising tabular grains rich in chloride has been disclosed: the presence in the reaction vessel of oxidized gelatin, containing less than 30 $\mu$moles of methionine per gram is of crucial importance. The same conditions for gelatin in a condition for use in emulsion preparation have also been mentioned for AgBr(I) tabular grains as e.g. in U.S. Pat. No. 4,713,320. The degree of oxidation of the protective colloid can be used in order to control the tabularity of such grains. Otherwise it is generally known that the use of e.g. phthalated gelatin as a protective colloid has a strong influence on the decrease of the percentage of the total projected area represented by said tabular grains.

The protective colloid used as a binder and added in addition before coating of hydrophilic colloidal layers on a suitable support is also relevant in determining the physical properties of the resulting coated film material. Properties as e.g. dimensional stability, scratchability, curl, pressure sensitivity and sludge formation after processing are highly dependent on the choice of the protective colloid. A phenomenon like pressure sensitivity may appear as pressure marks, pressure sensitization or desensitization, wherein both the protective colloid and the coated matrix have to dissipate the energy developed by the pressure force when the coated layer is dried and deformed afterwards in packaging, before and after exposure and by processing. In the dry state pressure sensitization or desensitization may occur. Crystals having a cubic or a tabular habit are usually very sensitive to pressure sensitization.

Moreover thin coated layers by coating lower amounts of binder e.g. for rapid processing applications makes this failure become worse, especially for materials coated from layers having thin tabular silver halide grains.

Since adsorption of the protective colloid occurs at the crystal surface, development characteristics are further influenced by said protective colloid. In the wet state pressure sensitization of the film material is related with the vulnerability of the coated layers and thus with its degree of hardening or cross-linking of the binder material. This phenomenon is usually called the "roller mark" or "pressure mark" phenomenon.

OBJECTS OF THE INVENTION

Therefor it is an object of the present invention to provide a method to prepare emulsions comprising silver halide tabular grains showing an improved pressure sensitivity.

It is further especially contemplated to provide photographic materials comprising layers coated from emulsions prepared by the method of this invention comprising tabular grains, wherein said materials neglectible pressure marks in rapid processing applications.

Other objects will become apparent from the description hereinafter.

SUMMARY OF THE INVENTION

According to this invention a method is described for preparing a light-sensitive silver halide emulsion comprising tabular grains containing colloidal silica sol as a protective colloid, said tabular grains having an average grain thickness of not more than 0.3 $\mu$m, an average aspect ratio of more than 12:1, a total projective area of said tabular grains of at least 50% and a coverage degree by silica sol particles within the range from 50 to 2000%, comprising following steps:

precipitating in a reaction medium silver halide by means of a double-jet or triple-jet technique applied to aqueous solutions of silver nitrate and halide salts in colloidal silica having an average particle size in the range from 0.003 $\mu$m to 0.30 $\mu$m as a protective colloid, in the presence of at least one onium compound, selected from the group consisting of a phosphonium compound, a iodonium compound and an ammonium compound, except for an ammonium compound containing $NH_4^+$-ions; but in the absence of gelatin, wherein a ratio by weight of said colloidal silica to said onium compound(s) is obtained between 3 and 400;

controlling nucleation and growth steps by means of variable flow rate(s) of aqueous solutions of silver nitrate and halide salts and/or by means of constant pAg-values during said steps;

subjecting the reaction medium to at least one physical ripening step;

desalting the reaction medium and redispersing the silver halide obtained;

chemically ripening the silver halide and adjusting a ratio by weight of colloidal silica sol to amount of silver halide, expressed as an equivalent amount of silver nitrate, to a value of at least 0.03 at every moment throughout precipitation in a reaction vessel.

Further according to this invention a method is provided comprising in addition to the above steps the further steps of adding to a redispersed and chemically ripened emulsion an amount of hydrogen-bridge forming polymer and/or colloidal silica in order to adjust a weight ratio of hydrogen bridge-forming polymer to silver halide expressed as an equivalent amount of silver nitrate between 0.05 and 0.40 and a ratio of silica to silver halide expressed as silver nitrate comprised between 0.03 and 0.30.

The invention also provides a silver halide light-sensitive photographic material having a support and, provided thereon, at least one hydrophilic colloid light-sensitive emulsion layer coated from a silver halide emulsion, comprising tabular silver halide grains, prepared according to the method of this invention and a processing method of said photographic material, after image-wise exposure, within a total processing time of less than 50 seconds.

DETAILED DESCRIPTION OF THE INVENTION

Silver halide tabular grains are crystals possessing two parallel faces with a ratio between the diameter of a circle having the same area as these faces, and the thickness, being the distance between the two major faces, equal to at least 2:1.

For radiographic applications the main photographic advantages of tabular grains compared to normal globular grains are a high covering power at high forehardening levels, a high developability and a higher sharpness especially in double side coated spectrally sensitized materials.

The light-sensitive silver halide emulsions comprising tabular grains, and particularly said tabular grains prepared according to the method of this invention, are characterized by the presence of colloidal silica sol as a protective colloid covering its crystal faces, by an average grain thickness of not more than 0.3 $\mu$m with an average aspect ratio of more than 12:1, a total projective surface area of said tabular grains of at least 50% and by a coverage degree by silica sol particles for any tabular grain within the range from 50 to 2000%.

Silica sols used as a protective colloid in the preparation method of silver halide emulsions comprising tabular grains according to this invention are commercially available such as the "Syton" silica sols ( trademarked products of Monsanto Inorganic Chemicals Div.), the "Ludex" silica sols (trademarked products of du Pont de Nemours & Co., Inc.), the "Nalco" and "Nalcoag" silica sols (trademarked products of Nalco Chemical Co), the "Snowtex" silica sols of Nissan Kagaku K.K. and the "Kieselsol, Types 100, 200, 300, 500 and 600" (trademarked products of Bayer AG). Particle sizes of the silica sol particles are in the range from 3 nm to 30 $\mu$m. Smaller particles in the range from 3 nm to 0.3 $\mu$m are preferred as the coverage degree per gram of silica sol that can be achieved will be higher and as the protective action of the colloidal silica will be more effective.

As thinner tabular grains provide the advantages mentioned hereinbefore to a larger extent, the grains having silica as a protective colloid according to this invention are preferred having an average grain thickness of not more than 0.2 $\mu$m. As thinner silver halide emulsion grains comprising silica easily exhibit a higher aspect ratio, an average aspect ratio of at least 8:1 and even up to 12:1 is easily attained and therefor an average aspect ratio of more than 12:1 is preferred for the grains according to this invention.

The total projective area for all tabular grains, measured from electron microscopic photographs taken from the emulsion crystals prepared according to the method of this invention is at least 50%, more preferably at least 70% and most preferably at least 90%.

The coverage degree mentioned hereinbefore has been determined as follows. From electron microscopic photographs taken from the silver halide tabular crystals having silica as a protective colloid, it is possible to calculate the average grain thickness and the average crystal diameter of a circle, having a surface equivalent with the crystal surface. Further from a calculation after determination of the losses of silica detected in the wash water of the emulsion comprising silver bromide or bromoiodide tabular grains, it is possible to determine the amount of silica that is effectively adsorbed at the crystal surface. The calculated surface of the adsorbed silica sol particles having a well-determined particle size per square unit of the tabular grains determines the coverage degree of the said grains. In a preferred embodiment the light-sensitive tabular silver halide grains covered with silica particles, according to this invention, have a coverage degree within the range from 75 to 1500%.

Emulsions comprising tabular silver halide emulsion grains covered with silica particles prepared according to the method of this invention preferably have silver halide compositions as e.g. silver chloride, silver chlorobromide, silver chlorobromoiodide, silver chloroiodide, silver bromide or silver bromoiodide.

Iodide ions can be provided by anorganic iodide salts and/or organic compounds releasing iodide ions as has e.g. been described in EP-A's 0 561 415, 0 563 701, 0 563 708, 0 649 052 and 0 651 284. Iodide ion concentrations up to 10 mole % may be present but concentrations up to 3 mole % are particularly preferred.

During precipitation of silver halide crystals in colloidal silica as a protective colloid onium compounds as co-stabilizers for colloidal silica are required as has been disclosed in EP-Specification 0 392 092 which is incorporated herein by reference, the proviso that at least one onium compound is present selected from the group consisting of a phosphonium compound, a iodonium compound and an ammonium compound, except for an ammonium compound containing $NH_4^+$-ions.

It has been found that before starting precipitation of silver halide tabular crystals in the presence of colloidal silica, aggregates of colloidal silica together with one or more co-stabilizing onium compound may be present, although not required. Aggregates formed between onium compounds and silica particles are acting as a protective colloid for the silver halide nuclei formed, just as e.g. gelatin.

According to this invention, it is required to add colloidal silica sol together with at least one onium compound immediately after the end of the nucleation step in order to stabilize the nuclei formed and the following growth step of the tabular grains comprising silica as at protective colloid.

Of the total amount of silver nitrate less than 10% by weight and, more preferably, 0.5% to 5.0% is added during nucleation which step consists preferably of an addition by means of a double-jet method of silver nitrate and halide salts at a pBr of at least 2.0.

Controlling at least one of the parameters like temperature, flow rate(s) of solutions containing silver and halide salts, pAg value and amount of crystal growth modifier, if present, has to be recommended in order to determine a number of nuclei formed during nucleation and in order to predict the average grain diameter of the silver halide tabular grains having colloidal silica as a protective colloid at the end of the precipitation step.

In these well-defined precipitation circumstances said tabular grains may have a monodisperse or heterodisperse distribution with a variation coefficient (ratio of standard deviation to average crystal diameter) varying between 0.15 (very monodisperse) and 0.45 (more heterodisperse). Further additions of silica and/or one or more onium compound (s) to a precipitation vessel may be necessary during further precipitation stages e.g. at the end of the nucleation stage, before growing nuclei, during physical ripening or even during a step, growing tabular grains.

According to the method of this invention it is required that particularly at least one onium compound selected from the group consisting of phosphonium compounds, iodonium compounds and ammonium compounds, except for compounds containing an $NH_4^+$-ion, are present during said growing step. Phosphonium, iodonium and the said ammonium compounds are onium compounds having site-directing properties providing tabular growth. Besides their function as a protective colloid, forming a stable network together with silica particles, said phosphonium compounds thus have a function as site-director in growing flat tabular grains. An especially preferred phosphonium compound is $(Phen)_3—P^+—CH_2—CH_2OH.Cl^-$, wherein Phen represents (substituted or unsubstituted) phenyl. Sulphonium and selenonium compounds, although also having colloidally stabilizing properties, are e.g. not useful as site-directors in growing tabular grains in silica.

Additional amounts of silica and, if necessary, one or more onium compound, one of which thereof being a phosphonium compound according to this invention, may be added to the reaction vessel in one or more portions or continuously in a triple-jet precipitation system. Especially preferred are additions during so called Ostwald ripening stages e.g. before the flow rate of the silver and/or halide solutions is increased in a double-jet precipitation system.

Onium compounds, acting as promotors of stable network formation with silica as a protective colloid, are represented by the following general formulae:

$$A^+X^-$$

wherein $X^-$represents an anion and $A^+$represents an onium ion selected from any of the following general formulae

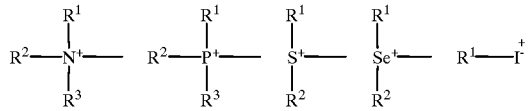

wherein:

each of $R_1$ and $R_3$ (same or different) represents hydrogen (except for ammonium $—NH_4^+$-), an alkylgroup, a substituted alkyl group, a cycloalkyl group, an aryl group or a substituted aryl group, $R_2$ represents any of the said groups represented by $R_1$ and $R_3$ or the atoms necessary to close a heterocyclic nucleus with either $R_1$ or $R_3$, the said onium ion being linked 1) to a polymer chain, or 2) via a bivalent organic linking group e.g., —O—, —S—, $—SO_2—$, etc., to any other of such onium structure, or 3) directly to any of the groups represented by $R_1$ Examples of onium compounds are disclosed in e.g. U.S. Pat. No. 3,017,270. In said specification examples are mentioned of trialkyl sulfonium salts, polysulfonium salts, tetraalkyl quaternary ammonium salts, quaternary ammonium salts in which the quaternary nitrogen atom is a part of a ring system, cationic polyalkylene oxide salts including e.g. quaternary ammonium and phosphonium and bis-quaternary salts.

Onium salt polymers having a sulphonium group or a selenonium group may be present, the proviso that, according to this invention at least one onium compound or onium salt polymer is present selected from the group consisting of phosphonium, iodonium and ammonium, excluding (inorganic) ammonium compounds containing $NH_4^+$-ions. Onium salt polymers are disclosed e.g. in U.S. Pat. No. 4,525,446.

Said onium compounds act as effective stabilizers of the colloidal stability of silver halide tabular crystals covered with silica, provided that, according to this invention, an appropriate amount is added to the reaction vessel versus the amount of silica present. To promote tabular grain growth however, according to the preparation method of this invention phosphonium compounds, iodonium compounds or ammonium compounds, except for those containing $NH_4^+$-ions, or a combination of said compounds are required du-ring growing tabular grains having a high aspect ratio of at least 12:1.

Ammonium compounds providing $NH_4^+$-ions like e.g. ammonium bromide, ammonium chloride, ammonium iodide etc. are disclaimed herein as said compounds are known for use in huge amounts as halide providing salts during precipitation of silver halide crystals in a reaction medium in a reaction vessel, but in this way they do not provide colloidal stability.

The photographic emulsions comprising silver halide tabular crystals covered with silica particles, according to the present invention, may have a homogeneous or a heterogeneous halide distribution within the crystal volume. A heterogeneous halide distribution may be obtained by application of growth steps having a different halide composition or by conversion steps e.g. by addition of halide ions that provide less soluble silver salts, onto existing tabular cores composed of more soluble silver salts. In the case of a heterogenous distribution of halide ions a multilayered grain structure is obtained. Obviously the tabular form has to be maintained in this case, in order to get silica tabular emulsion crystals in accordance with this invention.

The crystals may further be doped with whatever a dope as e.g. with $Rh^{3+}$, $Ir^{4+}$, $Ru^{4+}$, $Cd^{2+}$, $Zn^{2+}$, $Pb^{2+}$.

During precipitation grain growth restrainers or accelerators may be added to obtain crystals with a preferred average crystal size between 0.05 and 5 μm. Examples of grain growth accelerators are compounds carrying e.g. a thioether function.

It is important to avoid renucleation during the growth step of the nuclei formed in the nucleation step by controlling the preferred increasing rate of addition of the silver nitrate and the halide salts to make the distribution predictable of the emulsion crystals comprising tabular silica silver halide. Therefor in a preferred embodiment during nucleation and/or growth a grain growth modifier is present in the reaction vessel.

Silver halide nuclei can also be formed in a separate vessel and added to the reaction vessel wherein the growth step is performed. In said reaction vessel additional amounts of silica and onium compound may be present. If added during growing tabular crystals, one or more phosphonium, iodonium and/or ammonium compound(s), except for an ammonium compound containing $NH_4^+$-ions, or a combination of said compounds is(are) added according to this invention.

According to this invention it is possible to add the silver and halide salt solutions in a concentrated vessel, provided that the concentration of the silica and of onium compound (s) creating a "protective network" for the formed silver halide crystals is adapted thereto.

So opposite to the examples given in EP-A 0 528 476 concentrations going from 0.5 to 4 molar of silver halide and more preferably from 1 to 3 molar are attainable in the reaction vessel at the end of the precipitation.

Another advantage related thereto is that the coagulation washing method, followed by redispersion as described for emulsions having silica as protective colloid as e.g. in EP-A 0 517 961, is not required. In a preferred embodiment according to this invention desalting of the reaction medium is performed by ultrafiltration, which can be applied without complications with respect to fog level or pressure sensitivity after processing.

In a further stage after the end of the precipitation, desalting and redispersing of the silver halide emulsion, followed by chemically ripening provides an emulsion that can be prepared for coating in light-sensitive photographic layers of silver halide photographic materials.

The light-sensitive emulsion comprising silver halide tabular crystals with silica as protective colloid, prepared in accordance with the present invention is, after redispersion, a so-called primitive emulsion. However, said emulsion can be chemically sensitized as described i.a. "Chimie et Physique Photographic" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in this literature chemical sensitization can be carried out by effecting the ripening in the presence of small amounts of compounds containing sulphur and/or selenium and/or tellurium e.g. thiosulphate, thiocyanate, corresponding selenium and tellurium compounds, thioureas, sulphites, mercapto compounds, and rhodanines. The emulsions can be sensitized also by means of gold-sulphur, gold-selenium, gold-tellurium ripeners or by means of reductors e.g. tin compounds as described in GB-A 789,823, amines, hydrazine derivatives, formamidine-sulphinic acids, and silane compounds. Combinations of sulphur, selenium and tellurium together with gold are also useful. Chemical sensitization can further be performed with small amounts of Ir, Rh, Ru, Pb, Cd, Hg, Tl, Pd, Pt, or Au. One of these chemical sensitization methods or a combination thereof can be used. A mixture can also be made of two or more separately precipitated emulsions being chemically sensitized before mixing them.

According to this invention chemical ripening is performed before, during or after spectrally sensitizing the silver halide. Especially preferred is chemical ripening after spectrally sensitizing. In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains. This procedure is preferably applied to emulsions of the present invention, wherein the chemical sensitization proceeds in the presence of one or more phenidone compounds and derivatives, a dihydroxy benzene as hydroquinone, resorcinol, catechol and/or a derivative(s) therefrom, one or more stabilizers) or antifoggant(s), one or more spectal sensitizer(s) or combinations of said ingredients.

The light-sensitive emulsion comprising silver halide tabular crystals with silica as a protective colloid, prepared in accordance with the present invention, may be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534.

In a preferred embodiment tabular silver halide emulsion crystals according to this invention are spectrally sensitized with at least one dye having a structure corresponding to the general formula (I) given below.

(I)

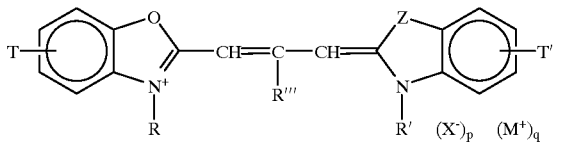

wherein

Z represents a nitrogen or an oxygen atom and is substituted with R" if Z is a nitrogen atom, R, R' and R" each independently represent substituted or unsubstituted alkyl, R'" represents hydrogen, substituted or unsubstituted alkyl or substituted or unsubstituted aryl, T and T' each independently represent the usual substituents known in the art, $(X^-)_p$ represents an negatively charged atom or group of atoms to compensate for the positive charge(s) present on the dye, and $(M^+)_q$ represents a positively charged atom or group of atoms to compensate for the negative charge(s) present on the dye and wherein p and q each represent an integer in order to get an electronically neutral compound.

Preferred spectral sensitizers suitable for use together with the emulsion crystals according to this invention are those of the type where R''' is $—C_2H_5$, Z is an oxygen atom, at least one of R and R' represents a sulphoalkyl group, preferably corresponding to the formulae $—(CH_2)_nSO_3^-$ wherein n equals 2, 3 or 4, $—(CH_2)_2—CH(CH_3)—SO_3^-$ and $—CH_2—CHY—CH_2—SO_3^-$ wherein Y represents —OH or —Cl;

a sulphatoalkyl group, preferably corresponding to the formula $—(CH_2)_nOSO_3^-$ wherein n equals 2, 3 or 4, an acylsulphonamido group, preferably corresponding to the formulae $—(CH_2)_n—C(O)—N(R'''')—SO_2—(CH_2)_mH$ wherein n equals 1, 2 or 3; m equals 1, 2, 3, etc.

$—(CH_2)_r—SO_2—N(R'''')—SO_2—(CH_2)_sH$ wherein r equals 2, 3 or 4; s equals 1, 2, 3, etc., $—(CH_2)_v—SO_2—N(R'''')—C(O)—(CH_2)_wH$ wherein v equals 2, 3 or 4; w equals 1, 2, 3, etc.

wherein R'''' represents H or alkyl;
and wherein T and T' each independantly represent 5-phenyl, 5-Cl, $5-OCH_3$ or $5-CH_3$.

Another class of preferred spectral sensitizers suitable for use together with the emulsion crystals according to this invention are those of the type where R''' is hydrogen, Z is an nitrogen atom, wherein T represents 5-phenyl, 5-Cl, $5-OCH_3$ or $5-CH_3$ and wherein T' represents $5,6-(Cl)_2$; 5-CN-6-Cl; $5-CF_3$-6-Cl; 5-Cl; 5-CN, $5-CF_3$, $5-CHF_2$, $5-SO_2CH_3$, $5-SO_2R'''''$ (R''''' representing a fluoro-substituted or non-fluoro-substituted alkylgroup), 5-COOR'''''' and $5-SO_2—N(R^x)(R^y)$ or $5-CO—N(R^x)(R^y)$, wherein $R^x$ and $R^y$ may each independently represent substituted or unsubstituted alkyl groups, or which may each independantly or together form a ring with the N-atom to which they are attached.

Especially preferred structures of the type wherein Z represents oxygen are those wherein T and T' each represent Cl or T represents Cl and T' represents Phenyl or vice versa and wherein R and R' each independantly represent one of the combinations of the formulae $—(CH_2)_nSO_3$ wherein n equals 2, 3 or 4, $—(CH_2)_2—CH(CH_3)—SO_3^-$ and $—CH_2—CHY—CH_2—SO_3^-$-wherein Y represents —OH or —Cl;

and wherein R, represents one of the formulae given above and R' corresponds to one of the formulae $—(CH_2)_pH$ wherein p equals 1, 2, 3 or 4;

$—CH_2—Phen—SO_3^-$ $—CH_2—Phen—COOH$ $—(CH_2)_q—Phen—COOH$ wherein q equals 1, 2 or 3.

An example of a useful spectral sensitizer according to the general formula given above is anhydro-5,5'-dichloro-3,3'-bis(n-sulphobutyl)-9-ethyloxacarbo-cyanine hydroxide or anhydro-5,5'-di-chloro-3,3'-bis(n-sulphopropyl)-9-ethyloxacarbo-cyanine hydroxide.

A suitable mixture of spectral sensitizers that can be applied is anhydro-5,5'-dichloro-3,3'-bis(n-sulphobutyl)-9-ethyl oxacarbo-cyanine hydroxide or anhydro-5,5'-dichloro-3,3'-bis(n-sulphopro-pyl)-9-ethyloxacarbo-cyanine hydroxide and anhydro-5,5'-dicyano-1,1'-diethyl-3,3'-di(2-acetoxyethyl)ethyl-imidacarbocyanine bromide.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

The ratio of silica to silver halide is determined at the stage of precipitation and/or by further addition of silica at the redispersion stage or later. It is possible to add an amount of hydrogen-bridge forming polymer e.g. gelatin. If added, it is preferred, to make the emulsion(s) comprising silver halide tabular grains having silica as a protective colloid ready for coating by addition to the emulsion(s) of an amount of hydrogen-bridge forming polymer in such an amount that a weight ratio of hydrogen bridge-forming polymer to silver halide expressed as equivalent amount of silver nitrate is comprised between 0.05 and 0.40 and, more preferably, between 0.15 and 0.30. Otherwise the preferred ratio of silica to silver halide expressed as silver nitrate is comprised between 0.03 and 0.3, more preferably, between 0.05 and 0.15, (and still more preferably between 0.02 and 1.0).

To the emulsion(s) comprising silver halide tabular grains prepared in accordance with the present invention may be added compounds preventing the formation of fog or stabilizing the photographic characteristics prior to, during, or after the chemical ripening thereof or during the production or storage of photographic elements or during the photographic treatment thereof. Mixtures of two or more of these compounds can be used.

Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercaptotetrazole, mercaptopyrimidines, mercaptotriazines, benzothiazoline-2-thi-one, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,-278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are the compounds described in Research Disclosure N° 17643 (1978), Ch.VI.

The silver halide emulsions prepared in accordance with the present invention can be used to form one or more silver halide emulsion layers coated on a support to form a photographic silver halide element according to well known techniques.

Two or more types of emulsions comprising silver halide tabular grains that have been prepared differently according to this invention can be mixed in at least one emulsion layer for forming a photographic emulsion for use in accordance with the present invention.

The photographic element of the present invention may comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. No. 3,038,805–4,038,075–4,292,400 and in EP-Applications 93202059 filed Jul. 12, 1993 and 94200639 filed Mar. 11, 1994.

The photographic element of the present invention may further comprise various other additives such as e.g. compounds improving the dimensional stability of the photographic element, UV-absorbers, spacing agents, hardeners, and plasticizers as described below.

In accordance with this invention a light-sensitive photographic material, coated from emulsions comprising silver halide tabular crystals having silica as a protective colloid, is provided, having a support and, thereon, at least one hydrophylic colloid layer including at least one light-sensitive silver halide emulsion layer characterised in that said light-sensitive layer comprises at least one of said emulsions.

The layers of the photographic element, especially when the binder therein used is gelatin, can be hardened with appropriate hardening agents such as those of the epoxide type, those of the ethylenimine type, those of the vinylsulfone type e.g. 1,3-vinyl-sulphonyl-2-propanol, bis-(vinyl sulphonyl)-methane, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts as disclosed in U.S. Pat. No. 4,063,952 and with the onium-compounds as disclosed in EP-A 0 408 143.

The emulsion may be coated on any suitable substrate such as, preferably, a thermoplastic resin e.g. polyethyleneterephthalate, polyethylene naphthalate or a polyethylene coated paper support.

Suitable additives for improving the dimensional stability of the photographic element may be added i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Plasticizers suitable for incorporation in the emulsions according to the present invention are e.g. glycol, glycerine, or the latexes of neutral film forming polymers including polyvinylacetate, acrylates and methacrylates of lower alkanols as e.g. polyethylacrylate and polybutylmethacrylate.

Suitable UV-absorbers are i.a. aryl-substituted benzotriazole compounds as described in U.S. Pat. No. 3,533,794, 4-thiazolidone compounds as described in U.S. Pat. No. 3,314,794 and 3,352,681, benzophenone compounds as described in JP-A 2784/71, cinnamic ester compounds as described in U.S. Pat. No. 3,705,805 and 3,707,375, butadiene compounds as described in U.S. Pat. No. 4,045,229, and benzoxazole compounds as described in U.S. Pat. No. 3,700,455.

In-general, the average particle size of spacing agents is comprised between 0.2 μm and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Embedded in a photographic material the silver halide tabular crystals prepared according to this invention are surrounded by colloidal silica, serving as an extremely useful protective colloid. An especially advantageous effect resulting therefrom is the better resistance of the coated material to pressure phenomena. Emulsion layers in accordance with the present invention, and more particularly thin emulsion layers, are showing remarkable improvements concerning both resistance to stress and rapid processability compared to conventional emulsions prepared in gelatinous medium. As the ratio by weight of gelatin to silver halide decreases more pronounced pressure marks can be expected. Nevertheless as a result of the protective action of the adsorbed silica to the silver halide crystal surface much less pressure sensitivity appears, which cannot be expected to the same extent if silica is added as coating additive as has been suggested e.g. in JP-A's 05 053 230 and 05 088 285.

The photographic silica tabular silver halide emulsions can be used in various types of photographic elements such as i.a. in photographic elements for so-called amateur and professional photography, for graphic arts, diffusion transfer reversal photographic elements, low-speed and high-speed photographic elements, X-ray materials, micrografic materials etc.

In a preferred embodiment the photographic silver halide emulsions are used in X-ray materials. In X-ray photography a material with a single or a duplitized emulsion layer coated on one or both sides of the support may contain silver halide emulsions according to the invention. By using duplitized emulsions differing in photographic speed by at least 0.15 log E a gain in cross-over exposure in double side coated materials can be obtained.

The photographic material can contain several non-light sensitive layers e.g. a protective antistress topcoat layer, one or more backing layers, and one or more intermediate layers eventually containing filter- or antihalation dyes that absorb scattering light and thus promote the image sharpness. Suitable light-absorbing dyes used in these intermediate layers are described in e.g. U.S. Pat. Nos. 4,092,168 and 4,311,787, DE 2,453,217, and GB Patent 7,907,440. Situated in such an intermediate layer between the emulsion layers and the support there will be only a small negligable loss in sensitivity but in rapid processing conditions decolouration of the filter dye layers may form a problem. Therefor it should be recommended to decrease the thickness of the whole coated layer packet resulting in shorter drying times after washing in the processing cycle. Alternatively the use of intermediate layers situated between emulsion layer(s) and support, reflecting the fluorescent light emitted by the screens may bring a solution.

In color photography the material contains blue, green and red sensitive layers each of which can be single coated, but generally consist of double or even triple layers. Besides the light sensitive emulsion layer(s) the photographic material may contain several light-insensitive layers e.g. a protective antistress layer, one or more backing layers, one or more subbing layers, one or more intermediate layers e.g. filter layers, an after layer containing e.g. the hardening agent(s), antistatic agent(s), filter dyes etc.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide, and the usual ingredients like hardeners and wetting agents.

The support of the photographic material may be opaque or transparent e.g. a paper support or resin support. When a paper support is used preference is given to one coated at one or both sides with an α-olefin polymer e.g. a polyethylene layer which optionally contains an anti-halation dye or pigment. It is also possible to use an organic resin support e.g. cellulose nitrate film, cellulose acetate film, poly(vinyl acetal) film, polystyrene film, polyethylene terephthalate film, polyethylene naphthalate film, polycarbonate film, polyvinylchloride film or poly-α-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material containing tabular grains prepared according to the method of the present invention can be image-wise exposed by any convenient radiation source in accordance with its specific application.

Of course processing conditions and composition of processing solutions are dependent from the specific type of photographic material in which the tabular grains prepared according to the method of the present invention are applied. For example, in a preferred embodiment of materials for X-ray diagnostic purposes said materials may be adapted to rapid processing conditions, including the steps of developing, fixing, rinsing and drying. Preferably an automatically operating processing apparatus is used provided with a system for automatic regeneration of the processing solutions. The forehardened material may be processed using one-part package chemistry or three-part package chemistry, depending on the processing application determining the degree of. hardening required in said processing cycle. Within the scope of this invention applications within total processing times of up to 30 are possible, whereas applications up to 90 seconds are known as common praxis.

From an ecological point of view it is even possible to use sodium thiosulphate instead of ammonium thiosulphate and to reduce the regeneration amounts of developer and fixer.

A decreased pressure sensitivity for the materials coated from silver halide emulsions according to this invention is attained in various processing conditions and should be recognized as an exceptional advantage offered by the said silica tabular-silver halide emulsion crystals.

The following examples, being non-limitative, are illustrative for the invention. All percentages are percentages by weight unless otherwise stated.

EXAMPLES

Example 1

Emulsion A: Comparative Example (silver bromide composition)

The same photographic emulsion as in Example XVIII from EP-A 0 392 092 was prepared.

A photographic tabular grain emulsion was prepared and coated on a support according to the following procedure: 2000 ml of demineralized water, 83 ml of 30% Kieselsol 300F (trade-marked product of Bayer AG), 18.5 ml of a 1% solution of the stabilizing sulphonium compound sulphonium toluene sulfonate (reaction product from thiodiglycol and ethylene glycol di-toluene sulfonate) as described in Example I from EP-A 0 392 092 were mixed under constant stirring in a 12 l stainless steel vessel. After heating up to 70° C. (under continuous stirring), 1045 ml of demineralized water were added, the pH of the solution was brought to 3.0 by the addition of 6N sulfuric acid, and the pAg was brought to 9.49 by addition of a 2.94 molar solution of potassium bromide.

Precipitation in the above medium took place in two subsequent stages:

1) under balanced double jet conditions during a period of 18 sec flows of silver nitrate and potassium bromide were added at a rate of 25 ml/min; pAg control was effected by means of the automated electronic control apparatus for silver halide preparation disclosed by Claes and Peelaers in Photographische Korrespondenz 102, Band Nr. 10/1967, pp. 162.

Hereafter physical ripening took place during 15 min at 70° C.; then over a period of 5 minutes a silica sol solution according to the following composition was added dropwise: 217 ml of 30% silica sol, 36 ml of a 1% solution of the stabilizing sulphonium compound set forth hereinbefore, and 460 ml of demineralized water, the pH of the solution being adjusted to 3.0.

2) the pAg of the solution was adjusted to 9.05, then under balanced double jet conditions and with the pAg control method as described hereinbefore, the flows of silver nitrate and potassium bromide over a period of 64 min and 10 sec were steadily increased from 5 to 24.4 ml/min.

Hereafter the dispersion was cooled from 70 to 20° C. under constant stirring and further washed by dialysis as described in Example I from EP-A 0 392 092.

Result: The emulsion contains a small amount of tabular grains (total projective area of tabular grains is less than 50%).

Emulsion B: Inventive Example

Emulsion prepared in the same way as as Emulsion A, except for the use as a stabilizing onium compound of co-stabilizing phosphonium compound $(Phen)_3—P^+—CH_2—CH_2OH.Cl^-$, wherein Phen represents phenyl, in an equimolar amount as the sulfonium compound used in said Emulsion A. The corresponding cosi value (ratio by weight of costabilizing compound and amount of silica) was 0.006 (low coverage of silver bromide with silica).

Result: Total projective area of predominantly hexagonal tabular grains of more than 90% is obtained.

Emulsion C: Inventive Example (silver bromoiodide tabular grains)

The following solutions were prepared:

2.5 1 of a dispersion medium (C) containing 0.05 moles of potassium bromide was established at a temperature of 70° C. and pH was adjusted to 4.5;

a 2.94 molar silver nitrate solution (A);

a 2.94 molar potassium bromide solution (B1);

a solution containing 2.896 moles of potassium bromide and 0.044 mole of potassium iodide (B2). The initial UAg measured vs. a silver/silver chloride reference electrode was adjusted at −34 mV before starting the precipitation.

A nucleation step was performed by introducing solution A and solution B1 simultaneously in dispersion medium C both at a flow rate of 60 ml/min during 30 seconds. After a physical ripening time of 19 min 111 ml of 15% silica sol 'Kieselsol 500' (trademarked product of Bayer AG) were added. 30 seconds later 37 ml were added of a 5% solution of co-stabilizing phosphonium compound $(Phen)_3—P^+—CH_2—CH_2OH.Cl^-$, wherein Phen represents phenyl, acting as "protective network with silica" promoting agent and site-director promoting tabular growth as well. 30 seconds later on 300 mol of demineralized water was added and after 5 minutes during which stirring was further performed the pH value was adjusted to a value of 3.0 and the solution was stirred for another 5 minutes.

Then a growth step was performed by introducing by a double jet during 65 minutes and 36 seconds solution A starting at a flow rate of 2.5 ml/min during 5 minutes and 54 seconds and linearly increasing the flow rate to an end value of 12.5 ml/min during 41 minutes and 22 seconds, and solution B2 at an increasing flow rate as to maintain a constant mV-value, measured by a silver electrode versus a saturated calomel electrode (S.C.E.), of +10 mV.

125 g of a 5 wt % aqueous solution of gelatin were added and after stirring for 5 minutes pH was adjusted to a value of 3.3 with sulphuric acid. After vigorously stirring for 5 minutes 15 ml of a polystyrene sulphonic acid were added slowly. After sedementation and decantation the flocculate was washed twice with 4 1 of demineralized water.

For this Emulsion C the cosi value was 0.11 (substantially higher than for Emulsion B); the sisi value 0.10 (ratio by weight of silica sol and amount of silver halide, expressed as the equivalent amount of silver nitrate). Result: Total projective area of tabular grains of 98% is obtained.

Emulsion D: Comparative Example

Same preparation as for Emulsion C, except for the use of the same sulphonium costabilizing compound of Example I in EP-A 0 392 092 and in Emulsion A hereinbefore, instead of the phosphonium costabilizer in an equimolar amount. Result: The emulsion is colloidally unstable.

Example 2

Emulsion E (silver bromoiodide tabular grains)

The following solutions were prepared:

3 1 of a dispersion medium (C) containing 0.3 moles of potassium bromide was established at a temperature of 70 ° C. and pH was adjusted to 4.5;

a 2.94 molar silver nitrate solution (A);

a solution containing 1.47 moles of potassium bromide (B1)

a solution containing 1.43 moles of potassium bromide and 0.04 mole of potassium iodide (B2). The initial UAg measured vs. a silver/silver chloride reference electrode was adjusted at -34 mV before starting the precipitation.

A nucleation step was performed by introducing solution A and solution B1 simultaneously in dispersion medium C both at a flow rate of 20 ml/min during 30 seconds. After a physical ripening time of 15 min 500 ml of 15% silica sol 'Kieselsol 500' (trademarked product of Bayer AG) and 51.6 ml of a 5% solution of co-stabilizing phosphonium compound $(Phen)_3—P^+—CH_2—CH_2OH.Cl^-$, wherein Phen represents phenyl, acting as "protective network with silica" promoting agent and site-director promoting tabular growth as well. The pH value was adjusted to a value of 3.0 and the solution was stirred for another 5 minutes.

Then a growth step was performed by introducing by a double jet during 65 minutes and 36 seconds solution A starting at a flow rate of 2.5 ml/min and linearly increasing the flow rate to an end value of 12.4 ml/min, and solution B1 at an increasing flow rate as to maintain a constant mV-value, measured by a silver electrode versus a saturated calomel electrode (S.C.E.), of −50 mV.

After cooling of the vessel to about 40° C. dialysis was carried out in order to get a desalted solution having a conductivity of not more than 10 mS. The solution obtained was called emulsion E1. For the preparation of the other emulsions E2-E5 variations were made in the amount of 'Kieselsol 500' (expressed as SILICA in ml), mole % of silver present in the nucleation step (AGNUC), KSCN (in ml 2% solution) in the reaction vessel C or in solution B2 and the pAg value in the growth step the corresponding data of which have been summarised in Table 1.

The thus obtained silver bromoiodide tabular emulsions having 2 mole % of iodide ions showed grain characteristics as defined hereinafter.

The average diameter $d_{EM}$, average thickness d, average aspect ratio AR were obtained from electron microscopic photographs: the diameter of the grain was defined as the diameter of the circle having an area equal to the projected area of the grain as viewed in the said photographs. Moreover the average sphere equivalent diameter $d_M$ has been calculated from the values of "$d_M$" and "d" by means of the formula $$d_M=(3/2\times d_{EM}^2\times d)^{1/3}.$$

The average diameter $d_v$ was obtained statistical calculation after measurement of the individual currents generated by reduction of 1000 separate silver bromoiodide crystals with a micro electrode. As the said currents are representative for the volumes of the crystals their diameters were calculated from the volumes of the globes having an equivalent volume as the tabular grains. From these data, the standard deviation was calculated statistically and the value of the variation coefficient VAR, defined the the quotient of the standard deviations and average diameters was tabulated.

TABLE 1

| | | | KSCN | | |
|---|---|---|---|---|---|
| Em. No. | SILICA | AGNUC | C | B2 | pAg |
| E1 | 500 | 2 | — | — | −50 |
| E2 | 500 | 5 | — | — | −50 |
| E3 | 500 | 1 | — | — | −50 |
| E4 | 500 | 2 | — | 10 | −50 |
| E5 | 250 | 2 | — | 10 | −30 |

Moreover the procentual numeric amount of tabular grains counted is given together with the other data in the Table 2.

TABLE 2

| Em. No. | $d_{EM}$ (μm) | d (μm) | AR | % T (n) | $d_M$ (μm) | $d_V$ (μm) | VAR |
|---|---|---|---|---|---|---|---|
| E1 | 1.48 | 0.11 | 13.8 | 95 | 0.70 | 0.53 | 0.62 |
| E2 | 1.71 | 0.12 | 14.8 | 97 | 0.80 | 0.43 | 0.67 |
| E3 | 1.37 | 0.12 | 11.7 | 94 | 0.69 | 0.39 | 0.73 |
| E4 | 1.31 | 0.11 | 12.0 | 91 | 0.65 | 0.52 | 0.72 |
| E5 | 1.66 | 0.12 | 14.5 | 92 | 0.78 | 0.45 | 0.86 |

It can be concluded for the emulsions in Table 2 that a high percentage by number (at least 90%) of tabular grains having an aspect ratio of more than 5 was counted from the corresponding electron microscopic photographs. Further it could be detected that very thin crystals having an high aspect ratio were obtained.

During the redispersion of the emulsions an amount of inert gelatin was added so that the weight ratio of gelatin to silver halide (expressed as silver nitrate) was 0.25, the emulsion containing an amount of silver bromoiodide equivalent with 190 g of silver nitrate per kg.

The emulsions were chemically ripened with sulphur and gold at 47° C. for 4 hours in order to get an optimized relation between fog and sensitivity and were stabilized with 4-hydroxy-6-methyl-1,3,3a-tetrazaindene before coating on one side of a polyester support of 175 μm thickness. Therefor an optimum amount of toluene thiosulphonic acid was used as a weakly oxidizing predigestion agent before starting the chemical ripening, followed by the addition of 362.5 mg of anhydro-5,5'-dichloro-3,3'-bis(n.sulfobutyl)-9-ethyl-oxacarbo-cyanine hydroxide as spectral sensitizer, per mole of silver bromo-iodide. Further an amount of 200 mg of 1-p-carboxy-phenyl-5-mercaptotetrazole was added.

The emulsion layers were overcoated with a protective layer. Amounts of coating solutions were the same in all cases in the emulsion layer as well as in the protective layer.

The following ingredients were added per mole of silver halide before coating:

785 mg of 4-hydroxy-6-methyl-1,3,3a,7-tetraazaindene as antifogging agent and stabilizer;

39 mg of phloroglucin as hardening accelerator;

2.68 g of resorcin as hardening agent. Demineralized water was added in order to reach a concentration corresponding to about 200 g of silver nitrate pro liter of coating solution.

A protective coating composition was prepared containing per liter the following ingredients in demineralized water:

35.4 g of an inert gelatin;

37 g of silica sol with silica particles having an average diameter of from 7 to 10 nm;

20 g of an aqueous dispersion of matting agent (particle size: diameter of 2 aim) comprising polymethylmethacrylate (3.2%) and gelatin (10%);

225 mg of chromium acetate as a hardening agent;

300 mg of ammoniumperfluoro-octanoate (FC143, trade name product from 3M) and 750 mg of N-polyoxyethylene-N-ethyl-perfluoro-octane-sulfonamide (FC170C, trade name product from 3M) as surfactants;

1500 mg of phenol as preserving agent;

1000 mg of Mobilcer Q from MOBIL OIL as a lubricant.

Formaldehyde was added as a hardening agent.

As a comparative Emulsion a tabular silver bromoiodide emulsion was prepared in gelatinous medium according to the preparation method described in EP 569 075, Example 1, Emulsion 2.

As a result differences in coating amounts of silver halide crystals, expressed as the equivalent amount of silver nitrate and of gelatin in the emulsion layer were i.e. 3.6 g/m$^2$ of silver nitrate for the comparative example and for the silica emulsion, gelatin 1.80 and 0.90 g/m$^2$ respectively, so that the ratios of gelatin to silver nitrate for both emulsions were approximately 0.4 (for the comparative example) and 0.3 (for the examples corresponding to the invention) respectively.

After coating of the protective antistress layer, the total amount of gelatin coated was 3.10 and 2.20 g/m$^2$ respectively.

Due to the high amount of hardening agent said agent should be added to the coating composition of the protective topcoat layer just before coating so as to have a comparative water absorption.

On the opposite side a conventional antihalation backing layer was coated.

After coating and drying, the coated materials were exposed with with green light of 540 nm during 0.1 seconds using a continuous wedge.

Thereafter processed was performed during the 38 seconds processing cycle in the processing machine CURIX HT530 (Agfa-Gevaert trademarked name) with the following time (in seconds) and temperature (in °C.) characteristics:

| | | |
|---|---|---|
| loading | 0.2 sec. | |
| developing | 9.3 sec. | 35° C. in developer described below |
| cross-over | 1.4 sec. | |
| rinsing | 0.9 sec. | |
| cross-over | 1.5 sec. | |
| fixing | 6.6 sec. | 35° C. in fixer described below |
| cross-over | 2.0 sec. | |
| rinsing | 4.4 sec. | 20° C. |
| cross-over | 4.6 sec. | |
| drying | 6.7 sec. | |
| total | 37.6 sec. | |

Composition of Developer:
concentrated part

| | |
|---|---|
| water | 200 ml |
| potassium bromide | 12 grams |
| potassium sulphite (65% solution) | 249 grams |
| ethylenediaminetetraacetic acid, sodium salt, trihydrate | 9.6 grams |
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 111 grams |
| potassiurn iodide | 0.022 grams |
| 4-hydroxymethyl-4methyl-1phenyl-3-pyrazolidinone | 3 grams |
| Water to make 1 liter | |

pH adjusted to 11.15 at 25° C. with potassium hydroxide.

For initiation of the processing one part of the concentrated developer was mixed with 3 parts of water. No starter was added.

The pH of this mixture was 10.30 at 25° C.

Composition of Fixer:
concentrated part

| | |
|---|---|
| ammonium thiosulfate (78% solution) | 661 grams |
| sodium sulphite | 54 grams |
| boric acid | 25 grams |
| sodium acetate-trihydrate | 70 grams |
| acetic acid | 40 grams |
| water to make 1 liter | |

pH adjusted with acetic acid to 5.30 at 25° C.

To make this fixer ready for use one part of this concentrated part was mixed with 4 parts of water. A pH of 5.25 was measured at 25° C.

In Table 3 sensitometric data obtained after processing as well as figures for developed amounts of silver per $m^2$ (AGDEV), procentual amount of silver developed (% DEV), covering power (CP) and the qualitative evaluation of pressure marks (PM).

The sensitivity S has been determined at a density of 1 above fog and support density; the gradation G between densities 1.8 and 2.4 above fog F and support density.

As the amount of light needed to reach a density of 1.00 above fog and support density is lower for the more light-sensitive materials the sensitivity is higher for lower values. Expressed as in Table 2 in 100 times log exposure this means that every decrease with a value of 30 is indicative for a material with a sensitivity that is twice as high.

Values of F(fog), S(sensitivity) and G(gradation) are represented by values multiplied by 1000 for F and 100 for S and G respectively.

Pressure marks PM are generated prior to processing, thus in the dry state, e.g. during manufacturing, especially during the confection step. The sensitivity of the material for this type of pressure is simulated with a pressure test (see also EP-A 0 528 476) wherein pressure is applied upon the exposed material with different small wheels, each of them having a different weight and leaving differently marked rails upon the step wedge obtained after processing in a hand processor (to avoid pressure sensitivity marks, generated with contact at the rollers as mentioned hereinbefore).

Figures from "6" to "1" are indicative for materials evaluated as being "very bad" to "very good" for this type of pressure marks.

From Table 3 hereinafter it can be concluded that the emulsions comprising silver bromoiodide tabular grains, precipitated in silica sol in the presence of an onium compound are superior versus silver bromoiodide emulsions having the same crystal size but precipitated in gelatin (see emulsion COMP., where no silica is present in the coated layer). Especially the coatings of the Emulsions A1, A3 and A5 are outstanding from the point of view of fog-sensitivity relationship and pressure marks.

TABLE 3

| | P1 | | | | | |
|---|---|---|---|---|---|---|
| Em. No. | F | S | PM | AGDEV | % DEV | CP |
| COMP. | 20 | 178 | 6 | 6.50 | 85 | 58.0 |
| E1 | 74 | 169 | 2 | 5.77 | 89 | 59.1 |
| E2 | 61 | 173 | 2 | 5.63 | 85 | 52.0 |
| E3 | 107 | 160 | 3 | 5.57 | 88 | 61.9 |
| E4 | 153 | 178 | 2 | 4.59 | 87 | 46.7 |
| E5 | 37 | 181 | 3 | 5.53 | 80 | 60.8 |

Example 3

Emulsion F (silver bromoiodide tabular grains)

Emulsions F was prepared in the same way as Emulsion E, except for the addition after a physical ripening time of 15 min of 250 ml of 15% silica sol 'Kieselsol 500' instead of 500 ml (trademarked product of Bayer AG) together with 51.6 ml of a 5% solution of co-stabilizing phosphonium compound $(Phen)_3—P^+—CH_2—CH_2OH.Cl^-$ having the same functions as in Example 2.

Preparation for coating and coating procedure for the emulsion F1, together with the comparative emulsion prepared in gelatinous medium according to the preparation method described in EP 569 075, Example 1- Emulsion 3, was performed just as in Example 2. Exposure of the samples coated,processing and sensitometric evaluation was the same as in Example 2. The results are summarised in Table 4.

From Table 4 it can be concluded that for the emulsions comprising silver bromoiodide tabular grains, precipitated in silica sol in the presence of an onium compound, even for low amounts of silica sol the pressure sensitivity is remarkably reduced. An effective protection of the crystals by the colloidal silica used as a protective colloid is the crucial factor therefor.

TABLE 4

| | P1 | | | |
|---|---|---|---|---|
| Em. No. | F | S | G | PM |
| COMP. | 25 | 182 | 285 | 6 |
| F1 | 41 | 188 | 267 | 2 |

Example 4

Emulsion G (silver bromoiodide tabular grains)

Emulsion G was prepared in the same way as Emulsion E, except for the addition during the nucleation step of 150 ml of 15% silica sol 'ieselsol 500' instead of 500 ml (trademarked product of Bayer AG) together with 51.6 ml of a 5% solution of co-stabilizing phosphonium compound $(Phen)_3—P^+—CH_2—CH_2OH.Cl^-$. During growth the UAg-value was maintained at a value of −12 mV.

Preparation for coating and coating procedure for the emulsion G, together with the comparative emulsion prepared in gelatinous medium according to the preparation method described in EP 569 075, Example 1—Emulsion 2, was performed just as in Example 2.

Exposure of the samples coated, processing and sensitometric evaluation was the same as in Example 2. The results are summarized in Table 5.

TABLE 5

| | P1 | | | |
|---|---|---|---|---|
| Em. No. | F | S | G | PM |
| COMP. | 41 | 159 | 194 | 6 |
| G | 51 | 151 | 215 | 4 |

From Table 5 it can be concluded that for emulsions comprising silver bromoiodide tabular grains, precipitated in silica sol in the presence of an onium compound during the nucleation step, even with lower amounts of silica sol (ratio by weight of silica to silver of 0.1) it is possible to reach the desired sensitometry.

It is clear that a higher sensitivity gives rise to a worse pressure marks. However, for the more sensitive emulsion the grains of which have been precipitated in silica, pressure marks are still better than for the less sensitive comparative emulsion, prepared in gelatinous medium. Moreover gradation of the "silica emulsion" is higher although the fog level is higher.

Example 5

Emulsion H (silver bromoiodide tabular grains)

During nucleation Emulsion H was prepared in the same way as Emulsion E, except for the addition after a physical ripening time of 15 min of 250 ml of 15% silica sol 'ieselsol 500' instead of 500 ml (trademarked product of Bayer AG) together with 103.2 ml of a 5% solution of co-stabilizing phosphonium compound $(Phen)_3—P^+—CH_2—CH_2OH.Cl^-$ instead of 51.6 ml. During growth the UAg-value was maintained at a value of +8 mV.

Preparation for coating and coating procedure for the emulsion D, together with the comparative emulsion prepared in gelatinous medium according to the preparation method described in EP 0 569 075, Example 1—Emulsion 2, was performed just as in Example 2.

Exposure of the samples coated,processing and sensitometric evaluation was the same as in Example 2. The results are summarized in Table 6.

TABLE 6

| | P1 | | | |
|---|---|---|---|---|
| Em. No. | F | S | G | PM |
| COMP. | 21 | 160 | 274 | 6 |
| H | 69 | 159 | 226 | 1 |

From Table 6 it can be concluded that for the emulsions comprising silver bromoiodide tabular grains, precipitated in silica sol in the presence of an onium compound even with lower amounts of silica sol (ratio by weight of silica to silver of 0.15) it is possible to reach the desired sensitometry, provided that the amount of onium compound added to the reaction vessel is increased in order to guarantee a sufficient protection of colloidal stability of the silver halide crystal. Pressure marks are outstanding, although the fog level is higher.

What is claimed is:

1. Method for preparing a light-sensitive silver halide emulsion comprising tabular grains containing colloidal silica sol as a protective colloid, said tabular grains having an average grain thickness of not more than 0.3 $\mu$m, an average aspect ratio of more than 12:1, a total projective area of said tabular grains of at least 90% and a coverage degree by silica sol particles within the range from 50 to 2000%, comprising the following steps:

precipitating in a reaction medium silver halide by means of a double-jet or triple-jet technique applied to aqueous solutions of silver nitrate and halide salts in colloidal silica having an average particle size in the range from 0.003 $\mu$m to 0.30 $\mu$m as a protective colloid, in the presence of a phosphonium compound; but in the absence of gelatin, wherein a ratio by weight of said colloidal silica to said phosphonium compound is obtained between 3 and 400;

controlling nucleation and growth steps by means of variable flow rate(s) of aqueous solutions of silver nitrate and halide salts and/or by means of constant pAg-Values during said steps;

subjecting the reaction medium to at least one physical ripening step;

desalting the reaction medium and redispersing the silver halide obtained;

chemically ripening the silver halide and adjusting a ratio by weight of colloidal silica sol to amount of silver halide, expressed as an equivalent amount of silver nitrate, to a value of at least 0.03 at all tines during precipitation in a reaction vessel.

2. Method according to claim 1, wherein said phosphonium compound is $(Phen)_3—P^+—CH_2—CH_2OH.Cl^-$, wherein Phen represents phenyl.

3. Method according to claim 1, wherein said ratio by weight of said colloidal silica to said phosphonium compound(s) is between 30 and 100.

4. Method according to claim 1, wherein during nucleation and/or growth a grain growth modifier is present in the reaction vessel.

5. Method according to claim 1, wherein desalting of the reaction medium is performed by ultrafiltration.

6. Method according to claim 1, wherein chemical ripening is performed after spectrally sensitizing the silver halide.

7. Method according to claim 1, wherein the emulsion is made ready for coating by addition to the emulsion of an amount of hydrogen-bridge forming polymer and silica in such an amount that a weight ratio of hydrogen bridge-forming polymer to silver halide expressed as silver nitrate is between 0.05 and 0.40 and the ratio of silica to silver halide expressed as silver nitrate is between 0.03 and 0.30.

8. Method according to claim 7, wherein said ratio of silica to silver halide expressed as silver nitrate is between 0.05 and 0.15.

9. Method according to claim 7, wherein said emulsion is made ready for coating by adding a polymer forming hydrogen-bridges in such an amount that said weight ratio of said polymer to silver halide expressed as equivalent amount of silver nitrate, has a value between 0.15 and 0.30.

10. Method according to claim 1, wherein the emulsion is made ready for coating by addition to the emulsion of an amount of hydrogen-bridge forming polymer and silica in such an amount that a weight ratio of hydrogen bridge-forming polymer to silver halide expressed as silver nitrate is between 0.05 and 0.40 and the ratio of silica to silver halide expressed as silver nitrate is between 0.02 and 1.0.

11. Method according to claim 1, wherein the coverage degree of said tabular grains by silica sol particles is within the range from 75 to 500%.

12. Method according to claim 1, wherein the average grain thickness of the tabular grains is not more than 0.2 $\mu$m.

13. Light-sensitive silver halide photographic material comprising on a support at least one hydrophilic colloid light-sensitive layer coated from a silver halide emulsion prepared according to the method of claim 1.

14. Method of processing an image-wise exposed photographic material according to claim 13, comprising the steps of developing, fixing, rinsing and drying within a total processing time of less than 50 seconds.

15. Method according to claim 1, wherein the said tabular grains are predominantly hexagonal tabular grains.

* * * * *

UNITED STATES PATENT AND TRADEMARK OFFICE

CERTIFICATE OF CORRECTION

PATENT NO. : 6,312,882 B1
DATED : November 6, 2001
INVENTOR(S) : Ann Verbeeck

It is certified that error appears in the above-identified patent and that said Letters Patent is hereby corrected as shown below:

Column 1,
Line 17, delete "A";

Column 2,
Line 40, after "materials" insert -- show --;

Column 7,
Line 52, "Photographic" should read -- Photographique --;

Column 9,
Line 44, "$_5$-$SO_2R$"" ' " should read -- 5-$SO_2R$" " ' --;
Line 57, "-$(CH_2)_nSO_3$" should read -- -$(CH_2)_nSO_3$- --;

Column 16,
Line 64, " "$d_M$" " should read -- "$d_{EM}$" --;

Column 18,
Line 12, "2 aim)" should read -- 2 $\mu$m --.

Signed and Sealed this

Fourteenth Day of May, 2002

*Attest:*

*Attesting Officer*

JAMES E. ROGAN
*Director of the United States Patent and Trademark Office*